US007226714B2

(12) United States Patent
Ota

(10) Patent No.: US 7,226,714 B2
(45) Date of Patent: Jun. 5, 2007

(54) PROCESS FOR PRODUCING POLYMERIZED TONER

(75) Inventor: Nobuyasu Ota, Tokyo (JP)

(73) Assignee: Zeon Corporation, Tokyo (JP)

( * ) Notice: Subject to any disclaimer, the term of this patent is extended or adjusted under 35 U.S.C. 154(b) by 230 days.

(21) Appl. No.: 10/927,133

(22) Filed: Aug. 27, 2004

(65) Prior Publication Data

US 2005/0048393 A1 Mar. 3, 2005

(30) Foreign Application Priority Data

Aug. 29, 2003 (JP) ..... 2003-307804

(51) Int. Cl.
*G03G 9/08* (2006.01)

(52) U.S. Cl. ..... 430/137.15

(58) Field of Classification Search ..... 430/137.15, 430/137.17

See application file for complete search history.

(56) References Cited

U.S. PATENT DOCUMENTS 5,865,381 A * 2/1999 Mitsumura et al. ..... 241/18

6,309,788 B1 * 10/2001 Tsuji et al. ..... 430/137.17

FOREIGN PATENT DOCUMENTS

| | | |
|---|---|---|
| JP | 6-75429 | 3/1994 |
| JP | 10-301333 | 11/1998 |
| JP | 2001-166531 | 6/2001 |

* cited by examiner

*Primary Examiner*—John L Goodrow
(74) *Attorney, Agent, or Firm*—Armstrong, Kratz, Quintos, Hanson & Brooks, LLP

(57) ABSTRACT

A process for producing a polymerized toner, comprising a step 1 of preparing a polymerizable monomer composition comprising at least a polymerizable monomer and a colorant, and a step 2 of polymerizing the polymerizable monomer composition in an aqueous medium to form a colored polymer particles, wherein the step 1 comprises a dispersing step of dispersing the colorant finely in a mixed solution comprising at least a polymerizable monomer and a colorant with a media dispersing machine which comprises a rotor and a media particle separation screen mounted on a driving shaft and is operable to rotate simultaneously in association with rotation of the driving shaft.

17 Claims, 3 Drawing Sheets

PROCESS FOR PRODUCING POLYMERIZED TONER

BACKGROUND OF THE INVENTION

1. Field of the Invention

This invention relates to a process for producing a polymerized toner, more particularly, relates to a process for producing efficiently a polymerized toner having markedly improved dispersibility of a colorant, homogenous sharp particle diameter distribution and excellent toner properties such as image density and color tone.

2. Description of the Related Art

Electrophotographic process generally forms an electrostatic latent image with electric charge and light exposure on a photoconductive member prepared from a photoconductive material. The formed electrostatic latent image is then developed with a developer (toner) to give a toner image. The obtained toner image is transferred on a recording media such as transfer paper and fixed to give a visible image.

The developers are mainly composed of colored particles (or may be referred as "colored resin particles") with dispersed a colorant, a charge control agent and a parting agent in a binder resin and roughly classified into one component developer without including carrier particles and two components developer comprising carrier particles. Further, the developers are classified into non-magnetic and magnetic developers whether the colored particles contain magnetic particles or not.

The colored particles are roughly classified into a pulverized toner obtained by pulverization method and a polymerized toner obtained by polymerization method. The pulverization method fuses and kneads the binder resin, the colorant and the other additive components, and then pulverizes and classifies to give the pulverized toner as colored resin powder. The binder resin is synthesized in advance by polymerization of a polymerizable monomer.

While the polymerization method generally polymerizes a polymerizable monomer composition comprising at least the polymerizable monomer and the colorant in an aqueous medium to give the polymerized toner as colored polymer particles. Suspension polymerization method has been mainly used as such a polymerization method, in addition, other dispersion polymerization and emulsion polymerization methods are also known.

Recently, colorization is under rapid progress in electrophotographic procedure and a high quality toner capable to comply with color imaging apparatus is required. The color imaging apparatus is generally equipped with plural image forming parts and each image forming part forms different respective color toner image. Practically, each image forming part successively transfers color toner images of yellow, magenta, cyan and black on the same recording medium. The transferred images are fixed to give a colored image.

As explained above, the color imaging apparatus forms color images by overlapping various color toners and their high transparencies are required. In addition, the color toner is required excellent spectrorefractory feature to improve reproducibility of colors. In addition, the color toner is required to exhibit fixation at low temperature, precise control of positive or negative charge and simple process for production.

The colorant should be pulverized as far as possible and homogenously dispersed in the binder resin to satisfy these requirements. Therefore, sufficient homogenous fine dispersion of the colorants in polymerizable monomer is necessary for production of polymerized toner. Generally, substantially insoluble pigments and dyes have been used for liquid polymerizable monomers. The colorants are conventionally supplied as granules, however, difficult to homogenously disperse in the polymerizable monomers because of insufficient pulverization.

Insufficient dispersion of the colorants in polymerizable monomer composition causes formation of homogenous droplets of the polymerizable monomer composition difficult in aqueous media leading to broad range of particle diameter distribution of the polymerized toner or liable to decline the image density of obtained polymerized toner. Furthermore, insufficient miniaturization and uneven dispersion of the colorant lowers shelf stability of polymerizable monomer composition after dispersion process and liable to cause separation of the colorants during storage.

A number of methods have been proposed for the dispersion of colorants in polymerizable monomer using various media dispersing machines. Practical dispersion process for the dispersion of colorants in monomer system comprising at least a polymerizable monomer by a media type dispersing machine as shown by FIG. 5 is proposed (Japanese Patent Laid-open No. 6-75429).

The media type dispersing machine shown by FIG. 5 is constructed of a cylindrical casing (that is "stator") 201 having a liquid supplying inlet 202 with equipped plural agitator disks (that is "rotors") 207 on a driving shaft 210 and contains a number of media particles 208 in the inner space of the casing. A jacket 206 having a cooling medium inlet 204 and its outlet 205 is arranged on the outside wall of the cylindrical casing 201 so as to adjust the inner temperature with the cooling medium.

A mixed solution (slurry) comprising at least a polymerizable monomer and a colorant is continuously introduced in the casing through the liquid supplying inlet 202 by rotation of agitator disks 207 with the rotation of the driving shaft 210 so as to provide strong sharing force on the media particles and the mixed slurry to finely disperse the colorant in the mixed slurry. The mixed solution in which the colorant is finely dispersed (that is "dispersion") is separated from media particles by a media separating gap separator 209 and transferred to the outside through a liquid discharging outlet 203 on the upper part of casing 201.

The media type dispersing machine shown in FIG. 5 has wide internal space and increased rounding speed of the tip of agitator disks enhances pulverizing capacity and pushes the filled media particles on the inside wall of casing by centrifugal force of the agitator disks. This causes marked packing phenomenon and results in uneven distribution of filled layer of media particles in the apparatus and further causes increased flow of the mixed solution of media particles through thin and less resistant layer. This phenomenon is so called short pass and declines efficacy of pulverization and dispersion, and homogeneity.

In addition, the media type dispersing machine has drawbacks liable to localize the media particles in the media separating gap separator during dispersion treatment and increases inner pressure of the apparatus to lower the efficacy of dispersion.

Heretofore, a media type dispersing machine having a structure shown in FIG. 4 is also known. This media type dispersing machine has a structure composed of a cylindrical casing 101 with a liquid supplying inlet 102 and its outlet 103. In the casing, a driving shaft 110, a rotor 107 on the driving shaft 110, and a media particle separation screen 109 fixed on one side of the cylindrical casing 101 are arranged.

One terminal of the rotor 107 forms a cylindrical structure with plural media particle discharging slits 111 and a media particle separation screen 109 is arranged in the inside of the cylindrical structure. An internal space formed between the inner surface of the casing 101 and the outer surface of rotor 107 contains a number of media particles 108 providing a dispersion chamber. The outside wall of casing 101 is arranged with a jacket 106 equipped with a cooling medium inlet 104 and its outlet 105 so as to control the inner temperature of casing.

The structure of media type dispersing machine shown in FIG. 4 has a narrow space between the inner surface of casing 101 and the outer surface of rotor 107, and slurry supplied through the liquid supplying inlet 102 can be sufficiently dispersed with fully filled media particles 108.

However, this media type dispersing machine has a fixed media particle separation screen 109 and transportation of dispersed slurry to the outside through the media particle separation screen 109 and the liquid outlet 103 causes massive localization of media particles on the media particle separation screen 109 and declines the efficacy of dispersion.

A media particle stirring type wet dispersing machine including plural spherical media particles in the chamber is proposed as a dispersing procedure of fine particles of colorant in the liquid polymerizable monomer composition (Japanese Patent Laid-open 2001-166531).

This media particle stirring type wet dispersing machine has a structure including media particles between a rotating rotor and a separator. A liquid monomer mixture comprising fine particles of colorant is introduced through a liquid supplying inlet to the center of the inner chamber, disperses the colorant in the mixture by centrifugal force generated by the rotation of the rotor and the media particles and the resultant mixture is discharged outside from the inner chamber through the slits of separator.

However, no sufficient dispersion of the colorant can be obtained even by the use of the media particle stirring type wet dispersing machine and the media particles localize on the slits of separator, elevates the inner pressure and the dispersion efficacy is liable to decline.

A method using a high pressure percussion type dispersing machine ULTIMAIZER®. (HJP3000, Sugino Machine Ltd.) is proposed for the other method to disperse the colorants in polymerizable monomers (Japanese Patent Laid-open 1998-301333). The ULTIMAIZER® dispersing machine does not use media particles, loads pressure energy on the liquid, divides the stream in two pathways and forces countercurrent collision at the joint of two streams to pulverize the subject.

Application of ULTIMAIZER® dispersing machine in countercurrent collision causes marked temperature elevation of polymerizable monomer mixed solution comprising the colorant and may start polymerization during dispersion treatment. Thus, no sufficient pressurization in countercurrent collision can be performed.

BRIEF SUMMARY OF THE INVENTION

The object of the present invention is to provide a process for effective production of the polymerized toner with markedly improved dispersibility of a colorant, homogenous sharp particle diameter distribution, image density and color tone.

The inventers of the present invention dedicatedly investigated to accomplish the aforementioned objects and found that a media type dispersing machine, which comprises a cylindrical casing having a liquid supplying inlet and a liquid outlet, in which there are provided a driving shaft, and a rotor and a media particle separation screen mounted on the driving shaft and operable to rotate simultaneously in association with rotation of the driving shaft, is suitable for the dispersion of the colorant in polymerizable monomer composition.

According to the process of the present invention, in a step of preparation of a polymerizable monomer composition, a degree of dispersion of colorant may be controlled by the media dispersing machine such that the number of colorant particles having a major axis over 0.5 μm, included in a field of view of 100 μm×100 μm of said coating film, is preferably 5 or less, and null in most cases.

Thus, fine dispersibility of the colorant in polymerizable monomer composition and formativeness of droplets of the polymerizable monomer composition in an aqueous medium were markedly improved and gave excellent polymerized toner with characteristic features of toner such as sharp particle diameter distribution and image density. The process for production of the present invention is particularly suitable for production of various color toners by polymerization method. The present invention is accomplished on the bases of these findings.

Thus, according to the present invention, a process for producing a polymerized toner, comprising a step 1 of preparing a polymerizable monomer composition comprising at least a polymerizable monomer and a colorant, and a step 2 of polymerizing the polymerizable monomer composition in an aqueous medium to form a colored polymer particles, wherein:

the step 1 comprises a dispersing step of dispersing the colorant finely in a mixed liquid comprising at least a polymerizable monomer and a colorant with a dispersing machine, wherein:

(1) the dispersing machine is a media type dispersing machine which comprises a cylindrical casing having a liquid inlet and a liquid outlet, in which there are provided a driving shaft, and a rotor and a media particle separation screen mounted on the driving shaft and operable to rotate simultaneously in association with rotation of the driving shaft, wherein the rotor is provided at one end with a cylindrical portion having a plurality of media particle discharge slits, the media particle separation screen is located inside the cylindrical portion of the rotor, a liquid introduced from the liquid inlet into the casing passes through the media particle separation screen and is discharged out of the casing through the liquid outlet, and media particles are contained in an internal space between the inner surface of the casing and the outer surface of the rotor, and (2) the dispersing step comprises a step of continuously feeding a mixed liquid comprising at least the polymerizable monomer and the colorant from the liquid inlet into the casing, while the rotor and media particle separation screen are simultaneously rotated in association with the rotation of the driving shaft, so that the colorant is finely dispersed in the mixed liquid by virtue of centrifugal force generated by rotation of the rotor and media particles, and passing a polymerizable monomer dispersion with the colorant finely dispersed therein through the media particle separation screen to deliver the dispersion out of the dispersing machine through the liquid outlet, is provided.

DETAILED DESCRIPTION OF THE INVENTION

1. Step I for Preparation of Polymerizable Monomer Composition

The process for producing the polymerized toner of the present invention comprises a step 1 of preparing a polymerizable monomer composition comprising at least a polymerizable monomer and a colorant, and a step 2 of polymerizing the polymerizable monomer composition in an aqueous medium to form a colored polymer particles.

The aforementioned step 1 comprises a dispersing step of dispersing the colorant finely in a mixed solution comprising at least a polymerizable monomer and a colorant with a particular media type dispersing machine. The dispersing step is a step of dispersing the colorant finely in the polymerizable monomer.

The above dispersing step supplies a mixture of the polymerizable monomer and the colorant to the media type dispersing machine and prepares dispersion of the polymerizable monomer composition with finely dispersed the colorant. Additive components other than the colorant such as a parting agent and a charge control agent may be added, if necessary, in the mixed solution used as a raw material.

In order to improve dispersion efficiency, it is preferable to prepare the polymerizable monomer composition in which the colorant is finely dispersed by using a mixed solution substantially comprising only the polymerizable monomer and colorant and disperse or dissolve an additive component or components other than the colorant in the resultant polymerizable monomer composition. Some parts of the additives other than the colorant may be added to the aqueous medium at the time of forming droplets of the polymerizable monomer composition in the aqueous medium to transfer it into the droplets.

Therefore, the step 1 of preparation of the polymerizable monomer composition of the present invention comprises a case of preparation of the polymerizable monomer composition solely by the aforementioned dispersing step and a case of preparation of the polymerizable monomer composition by a dispersing step and a step of adding additives other than the colorant to the polymerizable monomer dispersion obtained in the dispersing step, as needed.

In the present invention, a starting material mixture comprising the polymerizable monomer and the colorant poured at first into the media type dispersing machine is called "mixed liquid" (slurry) and a mixture with finely dispersed colorant with the media type dispersing machine is called "polymerizable monomer dispersion" or merely "dispersion".

Figure 1:
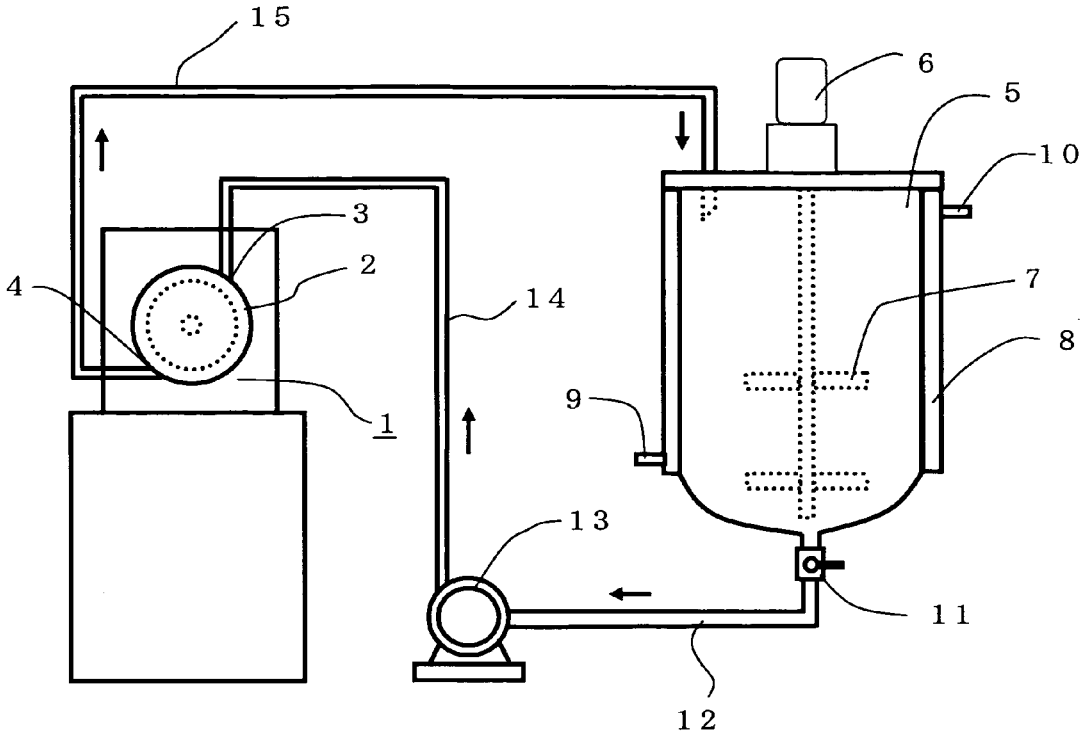
FIG. 1 shows an explanatory drawing of a dispersion system adopted in the examples of the present invention.

At the dispersing step according to the present invention, a specific media type dispersing machine is used. FIG. 1 is illustrative of one embodiment of the dispersing system using said media type dispersing machine. The dispersing system of FIG. 1 is built up of a media type dispersing machine 1 and a holding tank 5, which are connected together by way of a downstream flow comprising lines 12 and 14 and an upstream flow comprising a line 15.

The holding tank 5 is provided therein with an agitating blade 7 that is rotationally driven by an agitating motor 6. Around the holding tank 5, there is mounted a jacket 8 having an inlet 9 for introducing a temperature control medium therein and an outlet 10 for discharging the temperature control medium out of the holding tank, so that a liquid contained in the holding tank 5 can be controlled to any desired temperature.

A starting mixed liquid (also referred to as a "slurry") is prepared by feeding at least a polymerizable monomer and a colorant in the holding tank 5 and stirring them therein. Alternatively, the starting mixed liquid may have been previously prepared in other mixer. As a circulating pump 13 is put in operation, the mixed liquid in the holding tank 5 is introduced from a liquid inlet 3 in the media type dispersing machine 1 into a casing (also referred to as a "vessel" or "stator") by way of a valve 11, the line 12, the circulating pump 13 and the line 14.

In the mixed liquid, the colorant is finely pulverized and dispersed under strong shear force in the media type dispersing machine 1. A polymerizable monomer dispersion with the colorant finely dispersed therein is introduced from a liquid outlet 4 into the holding tank 5 via the line 15. The polymerizable monomer dispersion that has passed once through the media type dispersing machine may be again circulated through the same media type dispersing machine as often as desired for the purpose of achieving more uniform and finer dispersion of the colorant.

A polyermizable monomer tends to undergo premature partial polymerization upon heated to high temperatures. When the viscosity of the mixed liquid or dispersion is too high, on the other hand, the flowability of the monomer drops in the dispersing system. It is thus desired that the temperature of the liquid in the holding tank 5 be controlled by passing the temperature control medium such as cold or warm water through the jacket 8 in such a way as to come in the range of, for instance, 10 to 30° C.

Likewise, as the mixed liquid dispersion is subject to strong shear force in the media type dispersing machine, the temperature of the mixed liquid or dispersion rises, rendering partial polymerization of the polymerizable monomer likely to occur. It is thus desired that the temperature of the mixed liquid be controlled to within the range of about 10 to 30° C. by passing cooling water or other coolant through the jacket around the media type dispersing machine.

Figure 2:
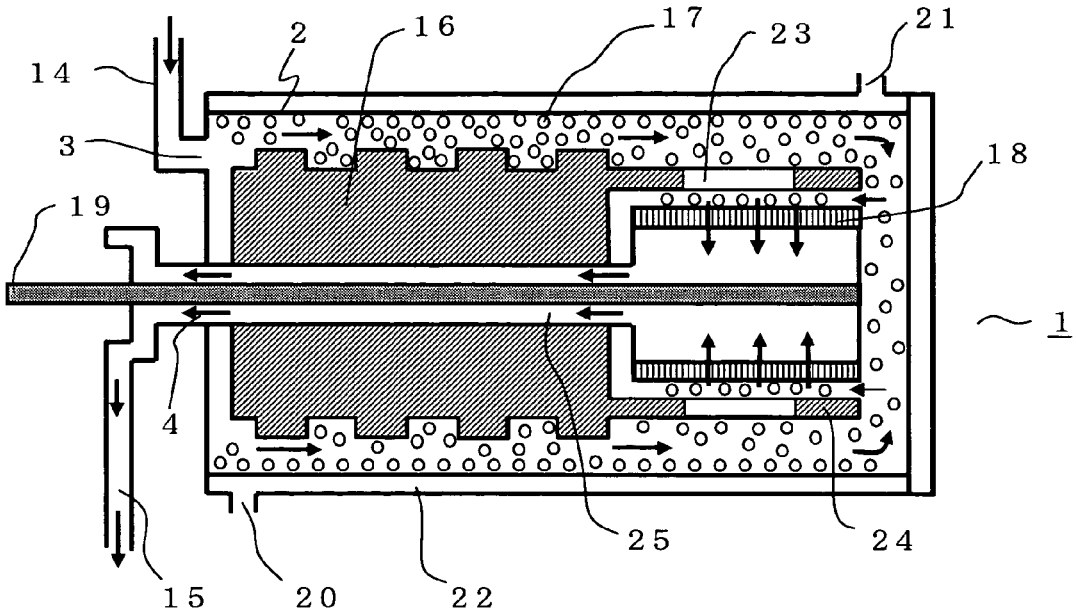
FIG. 2 shows a cross sectional drawing of the media type dispersing machine used in the present invention (Example 1).

FIG. 2 is illustrative in section of a specific media type dispersing machine used herein. The media type dispersing machine shown generally at 1 is built up of a casing 2 having a liquid inlet 3 and a liquid outlet 4. In that casing, there are provided a driving shaft 19, and a rotor 16 and a media particle separation screen 18 located on the driving shaft 19, which are operable to rotate simultaneously in association with rotation of the driving shaft 19.

An internal space between the inner surface of the casing 2 and the outer surface of the rotor 16 provides a dispersing chamber with media particles contained therein. At one end of the rotor 16, there is provided a cylindrical portion 24 having a plurality of media particle discharge slits 23. Inside this cylindrical portion 24 the media particle separation screen 18 is located. Introduced into the casing 2 through the liquid inlet 3, a liquid passes through the media particle separation screen 18, leaving the liquid outlet 4 via a liquid discharge path 25. The liquid discharge path 25, for instance, is interposed between the driving shaft 19 and the rotor 16. The rotor 16 may be provided with the liquid discharge path 25.

As the driving shaft 19 is rotated by a motor (not shown) mounted on the media type dispersing machine, the rotor 16 mounted on the driving shaft 19 and the media particle separation screen 18 are rotated at the same time. As a mixed liquid containing a polymerizable monomer and a colorant is continuously fed from a line 14 into the casing 2 through the liquid inlet 3, centrifugal force generated by the rotation of the rotor 16 is combined with the action of media particles 17 to apply strong shear force to the mixed liquid, so that the colorant can be finely dispersed throughout the polymerizable monomer.

The polymerizable monomer dispersion with the colorant finely dispersed therein passes through the media particle separation screen 18, and is discharged out of the liquid outlet 4 via the liquid discharge path 25. If this polymerizable monomer dispersion is fed back into the holding tank 5 from the line 15 for recirculation in the same media type dispersing machine, it is then possible to obtain a dispersion with the colorant more finely dispersed therein.

In the dispersing system shown in FIG. 1, the circulating pump 13 is operated to feed the mixed liquid or dispersion-continuously into the media type dispersing machine. Accordingly, the discharge pressure of the circulating pump 13 causes the polymerizable monomer dispersion with the colorant finely dispersed therein to pass through the media particle separation screen 18. Then, that dispersion is continuously discharged out of the liquid outlet 4 (for instance, into the holding tank). The media particle separation screen 18 comprises a grating or mesh form of screen. The media particles used, because of being larger than the mesh or grating space of the media particle separation screen 18, are kept from passing through the media particle separation screen.

Figure 3:
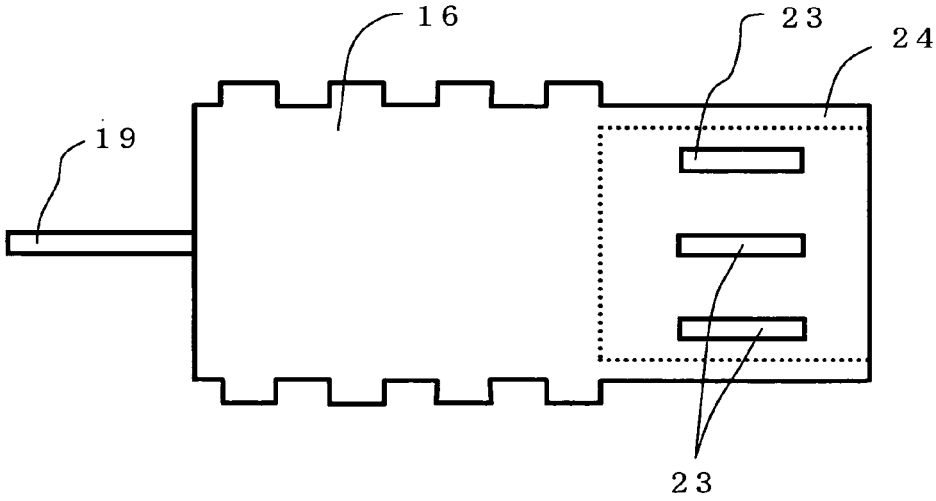
FIG. 3 shows an explanatory drawing of a rotor used in the media type dispersing machine.

Located on the driving shaft 19, the media separation screen 18 is rotated in association with the rotation of the driving shaft 19, and has a generally cylindrical configuration. More specifically, the outer periphery of the cylinder is formed of a screen, and the cylinder is closed up at one end and has an opening at the other end, which is in communication with the liquid discharge path 25. As shown in FIGS. 2 and 3, the rotor 16 is provided at one end with the cylindrical portion 24 having a plurality of slits 23, and inside the cylindrical member the media particle separation screen is located.

Each slit 23 is sized such that the media particles can pass through it. During the dispersing process, the polymerizable monomer dispersion with the colorant finely dispersed therein arrives at the surface of the media particle separation screen 18 along with the media particles, where the media particles receive the centrifugal force of the rotating media particle separation screen, going back into the dispersing chamber through the slits 23 formed on the cylindrical portion 24 of the rotor 16. In the meantime, only the polymerizable monomer dispersion is discharged out of the liquid outlet 4.

With this media type dispersing machine, therefore, it is possible to prevent the media particles 17 from remaining or otherwise resting locally on the surface of the media particle separation screen 18. In other words, this media type dispersing machine is improved in terms of the ability of separating media particles at the media particle separation portion, so that during the dispersing process, the media particle separation portion is prevented from jamming up, leading to an increase in the internal pressure of the media type dispersing machine. The increase in the internal pressure of the media type dispersing machine during the dispersing process results in the need of shutting down the machine or relaxing restrictions on running conditions. Because of having the high ability to separate media particles, however, this media type dispersing machine can run efficiently without any dispersing efficiency drop.

The media type dispersing machine used in the present invention is preferably constructed of materials with 20 or over of Rockwell hardness scale C (HRC) contacting to the mixed liquid or dispersion of the rotor and casing. HRC of the materials with in the range of HRC 20 or over prevents wear caused by sliding friction of the rotor and casing, and media particles filled in the space of casing, and contamination with contaminants due to friction of the polymerizable monomer dispersion.

The peripheral speed of rotor tip is preferably at 2 (two) m/sec or over, more preferably 4 (four) m/sec or over and particularly preferably at 8 (eight) m/sec or over. The higher the peripheral speed, the more efficient dispersion of the colorant in a short period of time can be obtained.

The rotor may be prepared of highly hard ceramics, for example, zircon or zirconia, highly hard metal such as steel and polymer materials such as ultra-high-molecular-weight polyethylene or nylon.

The media particles may be prepared from highly hard ceramics, for example, zircon or zirconia, a highly hard metal such as steel. The media particles are generally spherical particles. The media particles of 2 (two) mm or less diameters are preferable in view of dispersibility of the colorant in the polymerizable monomer and 1 (one) mm or less, particularly in the range of 0.05–0.5 mm is more preferable. The lower limit of the diameter of about 0.1 mm is more preferable.

The apparent packing fraction comprised in the media type dispersing machine is preferably 60–95% by volume, more preferably 70–90% by volume based on the internal space of the casing. High packing fraction leads to improve pulverization and dispersion efficiency of the colorant can be obtained and can prevent short pass of the mixed liquid or dispersion in the dispersion chamber.

In the dispersing step, the polymerizable monomer, the colorant and the other additive components, if desired, are poured in the holding tank 5 shown in FIG. 1 to give the mixed liquid. Mixed solution prepared by the other mixing apparatus may be poured in the holding tank 5.

Among additive components for toner, colorants such as pigments are difficult to finely pulverize and disperse. Other additives such as a parting agent and a charge control agent are comparatively easily dispersible and soluble in the polymerizable monomer. Therefore, dispersion treatment of a mixed liquid composed of the polymerizable monomer and the colorant with the media type dispersing machine followed by addition of dispersed other additives is preferable in view of effective dispersion treatment.

That is, dispersing step of mixed solution substantially composed of the polymerizable monomer and the colorant without addition of the other additive can be effectively accomplished in a short period of time using a comparatively small capacity holding tank or media type dispersing machine. A pigment dispersant is preferably used for smooth dispersion of the colorant. As a pigment dispersant, a basic high-molecular compound is preferable. The pigment dispersant is used generally at 0.05–3 and preferably 0.5–2 parts by weight per 100 parts by weight of the polymerizable monomer.

In the dispersing step, fine pulverization and dispersion of a colorant as far as possible in the polymerizable monomer is preferable. Dispersibility (degree of dispersion) of the colorant can be evaluated using particle diameter of colorant and glossiness of coated film of the dispersion as indices. In the dispersing step, it is preferable to disperse the colorant finely until the number of colorant particles having a major axis of over 0.5 μm, included in a field of view of 100 μm×100 μm, becomes 5 or less, and null in most cases.

More practically, the degree of dispersion of the colorant by the media type dispersing machine is controlled such that when a coating film formed using a polymerizable monomer dispersion in which the colorant is dispersed at a concentration of 3% by weight is observed at a magnification of 400× under an optical microscope, the number of colorant particles having a major axis over 0.5 μm, included in a field of view of 100 μm×100 μm of said coating film, is 5 or less, more preferably 3 or less and particularly preferably null. Control of the colorant concentration in the polymerizable monomer dispersion to make 3 (three) % by weight may be carried out by dilution of the dispersed sample solution with the polymerizable monomer or vaporization and removal of the polymerizable monomer.

The dispersibility of the colorant may be evaluated using glossiness of coating film formed with the polymerizable monomer dispersion as an index. In the present invention, at the dispersing step, the degree of dispersion of the colorant by the media type dispersing machine is controlled such that when a coating film formed using a polymerizable monomer dispersion, in which the colorant is finely dispersed at a concentration of 4.5% by weight, is measured at an angle of 20° by means of a glossmeter, the glossiness of the coating film is at least 60%, more preferably at least 65% and particularly preferably at least 70%. Adjustment of the concentration of the colorant to 4.5% by weight in the polymerizable monomer dispersion may be carried out similarly to aforementioned manner by dilution of the dispersed sample with the polymerizable monomer or vaporization and removal of the polymerizable monomer.

The dispersion is carried out by supplying the mixed solution in the holding tank 5 to the media type dispersing machine 1. Supplying the dispersed liquid to the media type dispersing machine for two or more times of circulation is preferable to accomplish sufficient dispersion of colorant. The times of circulation (θ) is calculated by the below mentioned equation.

$$\text{Number of circulation } (\theta) = \text{treating period (min.)} / \text{period required for one circulation (min./times)}$$

The required period (t) for one circulation is obtained by the following equation.

$$t = W/V$$

t: Required period for one circulation (min./times)

W: Amount of input in holding tank (kg)

V: Amount of supplied liquid with circulation pump (kg/min.)

The number of circulations in the dispersing step can be suitably selected such as according to the size of media type dispersing machine, kind of the colorant and volume of the solution to be treated. The number of circulations is preferably 2–30 times, more preferably 3–20 times and particularly preferably 5–15 times.

The polymerizable monomer composition comprises the polymerizable monomer and the colorant; and it may comprises various additives such as a charge control agent, a parting agent, a molecular weight modifier, a lubricant and a dispersion agent as needed. The polymerizable monomer composition is polymerized in the presence of a polymerization initiator, thus, the polymerization initiator is added in the polymerizable monomer composition before the start of polymerization.

(1) Polymerizable Monomer

A monovinyl monomer is used as a main component in the polymerizable monomers in the present invention. The monovinyl monomers includes, for example, aromatic vinyl monomers such as styrene, vinyltoluenes and α-methylstyrene; (meth)acrylic acid; derivatives of (meth)acrylic acid such as methyl (meth)acrylate, ethyl (meth)acrylate, propyl (meth)acrylate, butyl (meth)acrylate, 2-ethylhexyl (meth) acrylate, cyclohexyl (meth)acrylate, isobornyl (meth)acrylate, dimethylaminoethyl (meth)acrylate and (meth)acrylamide; and monoolefin monomers such as ethylene, propylene and butylenes.

The monovinyl monomers may be preferably used singly such as aromatic vinyl monomers or in combination with an aromatic vinyl monomer and the derivative of (meth)acrylic acid.

Combinations of the monovinyl monomers with a crosslinkable monomer such as divinylbenzene, improve offset characteristic feature. The crosslinkable monomers may be used singly or in combination of two or more monomers and generally 10 parts by weight or less, preferably 0.01–7 parts by weight, more preferably 0.05–5 parts by weight, and specifically preferably 0.1–3 parts by weight per 100 parts by weight of the monovinyl monomers are used.

A combination of the monovinyl monomers with a macromonomer provides favorable balance between shelf stability at elevated temperature and fixability at low temperature. The macromonomers are macromolecules having polymerizable carbon-carbon unsaturated double bonds at the terminals of molecular chain and generally oligomers or polymers having number average molecular weight of 1,000–30,000. The macromonomers within the above mentioned number average molecular weight range maintain fixability and shelf stability of polymerized toners without affecting fusibility of the macromonomer.

The polymerizable carbon-carbon unsaturated double bond at the terminal of molecular chain of macromonomers include such as acryloyl and methacryloyl group and the latter is preferable for the ease of copolymerization. A macromonomer providing polymers exhibiting higher glass transition temperature than that of a polymer obtained by polymerization of monovinyl polymer is preferable.

Specific examples of the macromonomers used in the present invention include polymers obtained by polymerizing one or more styrene, styrene derivatives, methacrylic esters, acrylic esters, acrylonitrile, methacrylonitrile or the like; and macromonomers having polysiloxane skeletons; among which hydrophilic polymers, especially, polymers obtained by polymerizing methacrylic esters or acrylic esters alone or in combination are preferred.

The macromonomers are generally used at 0.01–10 parts by weight, preferably 0.03–5 parts by weight, more preferably 0.05–1 part by weight per 100 parts by weight of monovinyl monomer. The amount of macromonomers used within the above mentioned range maintains the shelf stability and improves fixability of polymerized toner and are preferable.

(2) Colorants

Colorants such as various pigments and dyes used in the field of toner including carbon black and titanium white can be used. Black colorants such as a carbon black, nigrosine based dyes and pigments, and magnetic particles such as cobalt, nickel, triiron tetraoxide, iron manganese oxide, iron zinc oxide and iron nickel oxide can be enumerated. A carbon black with primary particle diameter of 20–40 nm gives favorable image quality with improved safety to environmental conditions and is preferable.

Colorants for preparation of color toners include yellow, magenta and cyan colorants in addition to aforementioned black colorants.

Yellow colorants such as condensed azo compounds, isoindolinone compounds, anthraquinone compounds, azo metallic complexes, methine compounds and allyl amide compounds are used. Practical examples include C.I. pigment yellow 3, 12, 13, 14, 15, 17, 62, 65, 73, 74, 83, 90, 93, 95, 96, 97, 109, 110, 111, 120, 128, 129, 138, 147, 155, 168, 180, 181, 185 and 186. Other yellow colorants such as naphtol yellow S, Hansa Yellow G and C.I. Vat Yellow are enumerated.

Magenta colorants such as condensed azo compounds, diketopyrrolopyrole compounds, anthraquinone compounds, quinaclidone compounds, basic dye lake compounds, naphthol compounds, benzimidazolone compounds, thioindigo compounds and perylene compounds are enumerated. Practically, for example, C.I. pigment red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251 and 254 are enumerated. Other magenta colorants such as C.I. pigment violet 19 may be illustrated.

Cyan colorants such as copper phthalocyanine compounds and their derivatives, anthraquinone compounds and basic dye lake compounds can be illustrated. Practical examples include C.I. pigment blue 1, 2, 3, 6, 7, 15, 15:1, 15:2, 15:3, 15:4, 16, 17, 60, 62 and 66. The other cyan colorants such as phthalocyanine blue, C.I. Vat blue and C.I. Acid blue can be enumerated.

These colorants can be used singly or in two or more combinations. The colorants are used at 0.1–70, preferably 1–50 parts by weight and more preferably 1–20 parts by weight per 100 parts by weight of the polymerizable monomers.

(3) Charge Control Agents

Addition of various positive or negative charge control agents to the polymerizable monomer composition is preferable to improve charging property of the polymerized toner. Charge control agents, for example, metal complexes of carboxyl group or nitrogen comprising organic compounds, metal comprising dyes, nigrosine, charge control resins may be enumerated.

Practical examples of charge control agents include charge control agents such as BONTRON® N-01 (Orient Chemical Ind., Ltd.), Nigrosine base EX (Orient Chemical Ind., Ltd.), SPILON® black TRH (Hodogaya Chemical Co., Ltd.), T-77 (Hodogaya Chemical Co., Ltd.), BONTRON® S-34 (Orient Chemical Ind., Ltd.), BONTRON® E-81 (Orient Chemical Ind., Ltd.), BONTRON® E-84 (Orient Chemical Ind., Ltd.), BONTRON® E-89 (Orient Chemical Ind., Ltd.), BONTRON® F-21 (Orient Chemical Ind., Ltd.), COPY CHARGE NX VP434 (Clariant AG), COPY CHARGE NEG VP2036 (Clariant AG), LR-147 (Japan Carlit Co., Ltd.) and Copy blue PR (Clariant AG); and charge control resins such as copolymers comprising a quaternary ammonium (salt) or sulfonic acid (salt).

In the present invention, the charge control resin is preferably used. Negative charge control resin having polymer side chains selected form the group consisting of i) carboxyl group or its salts, ii) phenol group or its salts, iii) thiophenol group or its salts, and iv) sulfonic acid group or its salts are illustrated.

Salts formed from substituents contained in the side chain of polymers includes salts with metal such as zinc, magnesium, aluminum, sodium, calcium, chromium, iron, manganese and cobalt; and salts with organic base such as ammonium, pyridinium and imidazolium ions. Among them, a charge control resin having sulfonic acid group and its salts in its side chains are preferable, and a charge control resin having polymer chains which have vinyl monomer units and have sulfonic acid group and its salts in its side chain are more preferable.

Positive charge control resin for example resins having amino group such as $—NH_2$, $—NHCH_3$, $—N(CH_3)_2$, $—NHC_2H_5$, $—N(C_2H_5)_2$ and $—NHC_2H_4OH$, and functional group with these amino group converted into ammonium salts are enumerated.

The weight average molecular weight of the charge control resins is generally 2,000–30,000, preferably 4,000–25,000, and more preferably 6,000–20,000.

The charge control agents are used generally at 0.01–10 parts by weight and preferably 0.1–10 parts by weight per 100 parts by weight of the polymerizable monomer.

(4) Parting Agents

A parting agent may be comprised in the polymerizable monomer composition for prevention of offset and to improve parting ability in fixing with a heat roller.

The parting agents include, for example, polyolefin waxes such as low molecular weight polyethylene, low molecular weight polypropylene and low molecular weight polybutylene; vegetable natural waxes such as candelilla, carnauba, rice, Japan wax and jojoba; petroleum waxes such as paraffin, microcrystalline and petrolatum and their modified waxes; synthetic waxes such as Fischer-Tropsch wax; polyfunctional ester compounds such as pentaerythritol tetramyristate, pentaerythritol tetrapalmitate and dipentaerythritol hexamyristate.

These parting agents may be used singly or in two or more combinations. Among these parting agents, synthetic waxes, terminal modified polyolefin waxes, petroleum waxes and polyfunctional ester compounds are preferably used.

The parting agents are used generally at 0.1–50 part by weight, preferably at 0.5–20 parts by weight and more preferably at 1–10 parts by weight per 100 parts by weight of the polymerizable monomer.

(5) Lubricants and Dispersion Agents

In order to give homogenous dispersion of the colorant, lubricants such as fatty acids such as oleic acid and stearic acid, and their metal salts such as Na, K, Ca, Mg and Zn salts, and dispersion agents such as silane or titanium coupling agents may be comprised in the polymerizable monomers. These lubricants and dispersion agents are generally used at 1/1000 to 1/1 ratios to the weight of colorants.

(6) Polymerization Initiators

Persulfates such as potassium or ammonium persulfate; azo compounds such as 4,4'-azobis(4-cyanovaleric acid), 2,2'-azobis[2-methyl-N-(2-hydroxyethyl)propionamide], 2,2'-azobis(2-amidinopropane) dihydrochloride, 2,2'-azobis (2,4-dimethylvaleronitrile), 2,2'-azobisisobutylonitrile; peroxides such as di-tert-butyl peroxide, dicumyl peroxide, lauroyl peroxide, benzoyl peroxide, tert-butyl peroxy-2-ethyl hexanoate, tert-hexyl peroxy-2-ethyl hexanoate, tert-butyl peroxypivalate, diisopropyl peroxydicarbonate, di-tert-butyl peroxyisophthalate, 1,1',3,3'-tetramethylbutyl peroxy-2-ethyl hexanoate and tert-butyl peroxyisobutylate may be enumerated as polymerization initiators of the polymerizable monomer. Redox initiators in combinations with these polymerization initiators and a reducing agent may also be used as polymerization initiators.

Among these initiators, oil-soluble initiators soluble in the polymerizable monomer are preferably selected. Furthermore, a water-soluble polymerization initiator may be simultaneously used with the oil-soluble polymerization initiator.

The polymerization initiators are generally used at 0.1–20 parts by weight, preferably at 0.3–15 parts by weight and more preferably 0.5–10 parts by weight per 100 parts by weight of the polymerizable monomer.

The polymerization initiators may be added to the polymerizable monomer in advance, however, they can be added preferably during or after the droplet formation process of the polymerizable monomer composition, or directly to a suspension during the polymerization reaction.

(7) Molecular Weight Modifier

Addition of a molecular weight modifier is preferable for polymerization. The molecular weight modifier such as mercaptans of tert-dodecylmercaptan, n-dodecylmercaptan, n-octylmercaptan and 2,2,4,6,6-pentamethylheptane-4-thiol; halogenized hydrocarbons of carbon tetrachloride or carbon tetrabromide can be enumerated. These molecular weight modifiers are generally comprised in the polymerizable monomer composition before the start of polymerization, however, they may be added during the polymerization reaction.

The molecular weight modifiers are generally used at 0.01–10 parts by weight and preferably at 0.1–5 parts by weight per 100 parts by weight of the polymerizable monomer.

In the step 1 for preparation of the polymerizable monomer composition, additive component other than the colorant may be comprised after dispersing step, if necessary, when the dispersion composed of the polymerizable monomer and the colorant is prepared in the dispersing step. In this case, an additive component other than the colorant may be dissolved or dispersed by pouring the component in the dispersion. A part of the additive component may be poured in an aqueous medium in the preparation process of droplets by pouring the polymerizable monomer composition in the aqueous medium and adsorption in the droplets of the polymerizable monomer composition.

2. Step 2 for Forming Colored Polymer Particles

The process for producing the polymerized toner of the present invention includes the step 2 for polymerizing the polymerizable monomer composition prepared in the step 1 in an aqueous medium to form a colored polymer particles. The step 2 adopts polymerization processes such as suspension, dispersion and emulsion polymerization processes. Among them, suspension polymerization process and emulsion polymerization process are preferable and suspension polymerization process is more preferable.

The suspension polymerization process includes polymerization of a polymerizable monomer composition comprising at least a colorant and a polymerizable monomer in an aqueous medium. The aqueous medium generally comprises a dispersion stabilizer. In the suspension polymerization, first, the polymerizable monomer composition is dispersed in an aqueous medium containing a dispersion stabilizer to form fine droplets, and then subjecting suspension polymerization to form colored polymer particles. Thereafter, the colored polymer particles may further be polymerized with a polymerizable monomer for shell to give colored polymer particles having core-shell structure.

Therefore, the process according to the present invention comprises, in step II, a step for forming an aqueous dispersion comprising the colored polymer particles or colored polymer particles having core-shell structure by polymerizing a polymerizable monomer composition comprising at least a colorant and a polymerizable monomer in an aqueous medium to form a colored polymer particles, and then polymerizing a polymerizable monomer for shell in the presence of the colored polymer particles as needed.

In the emulsion polymerization, first, the polymerizable monomer composition comprising the polymerizable monomer and the colorant is subjected to emulsion polymerization in an aqueous medium comprising an emulsifier, and then the resultant colored resin fine particles are aggregated and enlarged to toner particle size.

Water such as ion exchanged water is generally used as the aqueous medium and a mixed solution of water and a hydrophilic solvent such as alcohol may be used, if desired. The polymerization process is generally added with a dispersion stabilizer in an aqueous medium to enhance stability of droplets of the polymerizable monomer composition dispersed in the aqueous medium.

In the suspension polymerization process, a dispersion stabilizer such as a hardly water-soluble metal hydroxide colloid is used, and a surfactant may also be used together. Various emulsifiers are added to the aqueous medium for dispersion stabilization of polymerizable monomer or its composition in the emulsion polymerization.

The suspension polymerization process is preferable among above mentioned polymerization processes as the process can easily provide spherical colored polymer particles with desired particle diameter and core-shell structure. Thus, the present invention will be explained mainly by the suspension polymerization process.

Colloid of hardly water-soluble metallic compounds is suitable for the dispersion stabilizers of the present invention. The hardly water-soluble metallic compounds such as sulfates such as barium sulfate and calcium sulfate; carbonates such as barium carbonate, calcium carbonate and magnesium carbonate; phosphates such as calcium phosphate; metal oxides such as aluminum oxide and titanium oxide; metal hydroxides such as aluminum hydroxide, magnesium hydroxide and ferric hydroxide may be enumerated. Among them, colloid of the hardly water-soluble metal hydroxide narrows the particle diameter distribution of polymer particles and suitable for improvement of clear images.

The colloid of the hardly water-soluble metal compound may be prepared by conventional methods without restriction. However, colloid of a hardly water-soluble metal hydroxide obtained by adjusting the pH of an aqueous solution of a water-soluble polyvalent metallic compound to 7 or higher is preferred, and colloid of a hardly water-soluble metal hydroxide formed by reacting a water-soluble polyvalent metallic compound with an alkali metal hydroxide in an aqueous phase is particularly preferred. The colloid of hardly water-soluble metal compound preferably has number particle diameter distribution, D50 (50% cumulative value of number particle diameter distribution), of at most 0.5 μm and number particle diameter distribution, D90 (90% cumulative value of number particle diameter distribution), of at most 1 (one) μm.

The dispersion stabilizer is generally used at 0.1–20 parts by weight per 100 parts by weight of the polymerizable monomer. Excessively small ratios of the dispersion stabilizer to the polymerizable monomer make polymerization stability insufficient and liable to form polymerized agglomerated product. Conversely, excessively large ratio of the dispersion stabilizer to the polymerizable monomer makes the aqueous solution highly viscous and lowers the polymerization stability.

In the present invention, a water-soluble polymer may be used as a dispersion stabilizer, if necessary. The water-soluble polymers such as polyvinyl alcohol, methylcellulose and gelatin are enumerated.

No surfactant is necessary in the present invention, however, it may be used to stabilize suspension polymerization within a range not to increase environmental dependency of electric charge property of the polymerized toner.

The polymerization toner is a colored polymer particles including a binder resin in which the additives such as colorant and parting agent are dispersed and which is formed by polymerization of the polymerizable monomer. The colored polymer particles may be used as core to form a shell formed by a polymer layer on the surfaces thereof, thereby providing colored polymer particles having core-shell structure.

In case of suspension polymerization, the polymerized toner may be obtained, for example, by the following processes. The polymerizable monomer composition is dispersed and stirred in an aqueous medium comprising a dispersion stabilizer to give primary homogenous droplets of the polymerizable monomer composition generally having volume average particle diameter of 50–1,000 μm. Thereafter, polymerization initiator is preferably added in the aqueous medium to avoid early polymerization.

The polymerization initiator is added to the aqueous suspension comprising dispersed primary droplets of the polymerizable monomer composition and the mixture is further stirred using a high-speed rotary shear dispersing machine up to give aimed size of fine droplet particles similar to those of the colored polymer particles. Thus, the secondary fine droplets generally having volume average particle diameter of 1–12 μm is prepared.

The suspension solution comprising the secondary droplets of the polymerizable monomer composition is placed in the polymerization reaction vessel and caused to suspension polymerization generally at 5–120° C. and preferably at 35–95° C. Excessively low polymerization temperature demands a highly catalytically active polymerization initiator and the management of polymerization becomes difficult. While excessively high polymerization temperature causes bleed of the low melting point additives on the surface of polymerized toner and may lower the shelf stability of polymerized toner.

The volume average particle diameter and particle diameter distribution of fine droplets of the polymerizable monomer composition influence on the volume average particle diameter and particle diameter distribution of the polymerized toner. Excessively large particle diameter of droplets makes the formed colored polymer particles excessively large and decreases resolution of images. Wider particle diameter distribution causes scattered fixing temperature leading to cause troubles such as fog or toner filming. Thus, the secondary droplets of the polymerizable monomer composition with similar volume average particle diameter and particle diameter distribution to those of formed colored polymer particles are preferable.

The volume average particle diameter of droplets of the polymerizable monomer composition is generally 1–12 μm, preferably 2–10 μm and more preferably 3–8 μm. The volume average particle diameter of droplets is preferably 2–9 μm, more preferably 3–8 μm and further more preferably 3–7 μm to give highly fine images, particularly to give fine particles of polymerized toner. The particle diameter distribution of droplets of the polymerizable monomer composition (volume average particle diameter/number average particle diameter) is generally 1–3, preferably 1–2.5 and more preferably 1–2. Particularly, formation of extra fine droplets can be preferably accomplished by passing an aqueous dispersion medium comprising the polymerizable monomer composition through a gap between a rotor under high speed rotation and a surrounding stator around the rotor having small pores or comb.

One or more monovinyl monomers are selected as polymerizable monomer. The polymerizable monomer may be preferably used singly or combinations to give polymers with glass transition temperature, Tg, generally at 80° C. or lower, preferably at 40–80° C. and more preferably at 50–70° C. to lower the fixing temperature of the toner. In the present invention, Tg of the polymerized product constructing the binder resin is calculated from the kind of used polymerizable monomer and its used ratio, that is "calculated Tg".

The suspension polymerization provides colored polymer particles with dispersed additive components such as a colorant in the polymer particles of the polymerizable monomer. In the present invention, the resultant colored polymer particles are used as a polymerizing toner. A polymerized layer may further be formed on the colored polymer particles obtained by the suspension polymerization to give colored polymer particles having core-shell structure and to improve the shelf stability of the polymer particles, (that is "blocking resistance"), fixability at low temperature and fusibility in fixation.

Formation of the core-shell structure can be accomplished, for example, by further polymerization of the polymerizable monomer for shell in the presence of core particles using the colored polymer particles as core particles to give polymerized layer (shell) on the surface of the core particles.

The polymerizable monomer for shell uses those that can form polymerized product with higher Tg than that of polymerized components forming core particles to improve shelf stability of the polymerized toner. On the other hand, lowered set up of Tg of the polymer component of core particles may lower the fixing temperature of polymerized toner and improve characteristic feature in fusing. Thus, formation of colored polymer particles having core-shell structure in the polymerization process gives the polymerized toner capable to accommodate with high speed printing, full color printing and transparency of sheets used in overhead projector (OHP).

The polymerizable monomer for the formation of cores and shells can be suitably selected from aforementioned monovinyl monomers. The weight ratios of the polymerizable monomers for cores and those for shells are generally 40/60 to 99.9/0.1, preferably 60/40 to 99.7/0.3, more preferably 80/20 to 99.5/0.5. Excessively small ratios of the polymerizable monomers for shells give poor effect on improvement of shelf stability of the polymerized toner and excessively large ratios give small lowering effect in fixing temperature.

Tg of polymerized product formed from the polymerizable monomers for shells is generally over 50° C. to 120° C. or less, preferably over 60° C. to 110° C. or less, more preferably over 80° C. to 105° C. or less. The difference of Tg values between the polymerized product formed from the polymerizable monomers for cores and those for shells is preferably 10° C. or over, more preferably 20° C. or over and particularly preferably 30° C. or over. In most cases, the polymerizable monomers for cores are preferably selected from those capable to give Tg at 60° C. or less and preferably at 40–60° C. in view of balance between fixing temperature and shelf stability. While the polymerizable monomers for shells are preferably selected singly or in two or more combinations from those forming polymerized products exhibiting Tg at over 80° C. such as styrene and methyl methacrylate.

The polymerizable monomers for shells are preferably added to a polymerization reaction system as smaller size droplets than the average size of core particles. Excessively large particle diameter of droplets of the polymerizable monomers for shells liable to cause uneven polymerized product layer around the core particles. Micro-dispersion of a mixture of the polymerizable monomers for shells and an aqueous dispersion medium, for example, by an ultrasonic emulsifier and addition of the resultant dispersion to the polymerization reaction system gives fine droplets of the polymerizable monomers for shells.

No micro-dispersion treatment in an aqueous dispersion medium is necessary for the comparatively water-soluble polymerizable monomers for shells having water solubility of 0.1% by weight or over at 20° C. (for example, methyl methacrylate) because of their comparatively smooth transfer on the core particle surface, however, micro-dispersion treatment for the formation of homogenous shell is preferable. Micro-dispersion of the polymerizable monomers for shells having water solubility of less than 0.1% by weight at 20° C. (for example, styrene) is preferably carried out in an aqueous dispersion medium or dispersion by addition of an organic solvent having water solubility of 5% by weight or over at 20° C. (for example alcohols) to make smooth transition of the monomers on the core surface.

A charge control agent may be added, if desired, to the polymerizable monomers for shells. The charge control agent similar to that used in preparation of above mentioned core particles is preferably used. The charge control agent is generally used at 0.01–10 parts by weight and preferably 0.1–5 parts by weight per 100 parts by weight of the polymerizable monomers for shells.

Preparation of polymerized toner having core-shell structure is carried out by addition of the polymerizable monomer for shells to a suspension comprising core particles at one time, continuously or dividedly. Addition of the polymerizable monomer for shells together with a water-soluble radical initiator is preferable for effective formation of shells. Simultaneous addition of the polymerizable monomer for shells and the water-soluble polymerization initiator is presumed to accelerate the infiltration of the water-soluble polymerization initiator around outer surface of core particles with transfer of the polymerizable monomer for shells. This will help formation of polymerized layer on the surface of core particles.

The water-soluble polymerization initiators such as persulfate including potassium or ammonium persulfate and azo initiators including 2,2'-azobis[2-methyl-N-(2-hydroxyethyl)propionamide, 2,2'-azobis[2-methyl-N-[1,1-bis(hydroxymethyl)ethyl]-propionamide] may be enumerated. The required amount of the water-soluble polymerization initiators is generally 0.1–50% by weight and preferably 1–20% by weight per 100% by weight of the polymerizable monomer for shells.

The average thickness of shell is generally 0.001–1.0 μm, preferably 0.003–0.5 μm and more preferably 0.005–0.2 μm. Excessively thick shell lowers fixability of the polymerized toner and excessively thin shell lowers shelf stability of the polymerized toner.

The core particle diameter and the shell thickness of polymerized toner can be directly determined by observation of diameter of randomly selected particles and shell thickness with an electron microscopic observation. When the electron microscopic observation is unavailable, the core particle diameter and the shell thickness can be calculated from the particle diameter of core particles and the used amount of shell forming polymerizable monomer 3. Washing and Recovery Step The colored polymer particles are recovered after their formation process from aqueous medium and a process for removal of volatile organic compounds such as unreacted polymerizable monomer may be carried out before the recovery. Practically, for example, stripping treatment of aqueous dispersion comprising the colored polymer particles may be adopted to remove volatile organic compounds.

A washing process is carried out after formation process of the colored polymer particles, or removal of volatile organic compounds as mentioned earlier. That is, recovery of the colored polymer particles is carried out by conventional methods of dehydration, washing, filtration and drying, and the dried colored polymer particles are recovered. Generally the used dispersion stabilizer is removed prior the dehydration by solubilization, for example, washing with an acid or an alkali according to the kind of dispersion stabilizer.

For example, when the colloid of hardly water-soluble metal hydroxide such as magnesium hydroxide colloid is used as the dispersion stabilizer, an acid such as sulfuric acid is added to the aqueous dispersion to solubilize the dispersion stabilizer to water (this method is called "acid washing"). The pH of the aqueous dispersion is preferably adjusted to 5 or less by the acid washing.

After acid or alkali washing, the aqueous dispersion is filtered and dehydrated. After dehydration, the colored polymer particles are washed with water. Washing is carried out by repetitive supply and dehydration of washing water, however continuous washing is preferable for effective washing. Therefore, washing with water using a washing and dehydration apparatus is preferable. For example, continuous belt filter or siphon peeler type centrifuge may be enumerated as preferred washing with water and dehydration apparatus.

After washing process, wet colored polymer particles are dried. Fluid drying and vacuum drying can be enumerated for drying method, however, vacuum drying capable of drying under reduced pressure is preferable, and particularly a vacuum dryer equipped with agitating blades is preferable.

4. Polymerized Toner and Developer

The volume average particle diameter of the polymerized toner as colored polymer particles (including colored polymer particles having core-shell structure) produced by the process of the present invention is generally 1–12 μm, preferably 2–11 μm and more preferably 3–10 μm. Preferred volume average particle diameter of the polymerized toner to obtain highly fine images with improved resolution is 2–9 μm and more preferably as small as 3–8 μm.

The particle diameter distribution, Dv/Dp, expressed by the ratios of volume average particle diameter, Dv, and number average particle diameter, Dp, of the polymerized toner of the present invention is generally 1.7 or less, preferably 1.5 or less, more preferably 1.3 or less and particularly preferably 1.25 or less. Excessively large Dv of the polymerized toner is liable to decreases resolution. Wide particle diameter distribution of the polymerized toner causes increased ratio of large size toner particles and is liable to decreases resolution.

The shape of polymerized toner of the present invention is preferably spherical with major axis, dl, and minor axis, ds, and expressed by a ratio, dl/ds. The preferred ratio is substantially spherical of 1–1.3 and more preferably 1–1.2. When a substantially spherical toner is used as a non-magnetic one-component developer, the transfer efficiency of a toner image on a photoconductive member to a transfer medium is enhanced.

The polymerized toner produced by the process of the present invention can be used as a toner component of various developers and its application as a non-magnetic one component developer is preferable Application of the polymerized toner of the present invention to non-magnetic one component developer may be carried out by mixing with other external additives of inorganic particles or organic resin particles as a fluidizer and an abrasive, if necessary.

The inorganic particles such as silicon dioxide (silica), aluminum oxide (alumina), titanium oxide, zinc oxide, tin oxide, barium titanate and strontium titanate are enumerated.

The organic resin particles such as methacrylic acid ester polymer particles, acrylic acid ester polymer particles, styrene-methacrylic acid ester copolymer particles and styrene-acrylic acid ester copolymer particles, and core-shell type particles formed from styrene polymer as cores and methacrylic acid ester copolymer as shells are enumerated.

Among them, inorganic oxide particles are preferable as external additives and silicon dioxide is particularly preferable. The surface of inorganic particles may be treated to make hydrophobic. Silicon dioxide particles made to hydrophobic is particularly preferable.

Two or more external additives may be used in combinations and combinations of different average particle diameter of inorganic particles or mixtures of inorganic particles and organic particles are preferable. The amount of external additives is not definitive and generally 0.1–6 parts by weight per 100 parts by weight of the polymerized toner is used. Adhesion of the external additive to the polymerized toner is generally carried out by mixing and stirring them in a Henschel mixer.

EXAMPLES

Examples and comparative examples are shown below to more practically explain the present invention. Terms of "part" and "%" used in these examples and comparative examples are based on weight except otherwise stated. The determination and evaluation methods of various physical properties and characteristic features in the present invention are as follows.

(1) Separability of Media Particles

The separability of media particles is evaluated by the below mentioned criteria according to the determined results of inner pressure of casing during operation of the media type dispersing machine.

A: Operation of the media type dispersing machine can be proceeded without elevation of inner pressure of the casing and provides media particles with favorable separability in the media separating part.

B: Inner pressure of the casing elevates during operation and media particles localize in the media separating part.

(2) Viscosity of Polymerizable Monomer Dispersion After Dispersion Treatment of the Colorant.

The viscosity of the polymerizable monomer dispersion with dispersed colorant is determined with a digital viscometer (Brookfield). Determination of viscosity was carried out by the following conditions: liquid temperature=25° C., rotor number=No. 3 and speed of rotation=60 rpm.

(3) Dispersibility of the Colorant

A part of the polymerizable monomer dispersion with the dispersed colorant was sampled and made 3 (three) % by weight dispersion of the colorant by dilution with the polymerizable monomer of the same composition. The resultant dispersion was coated on a polyethylene terephthalate (PET) film using a doctor blade of 30 μm distances and dried to give a film. The film was observed with an optical microscope at a magnification of ×400 and numbers of the colored particles over 0.5 μm of major axis in a field of 100 μm×100 μm were counted.

(4) Glossiness of the Polymerizable Monomer Dispersion After Dispersion Treatment of the Colorant A part of the polymerizable monomer dispersion with the dispersed colorant was sampled and made 4.5% by weight dispersion of the colorant by dilution with the polymerizable monomer of the same composition. The resultant dispersion was coated on a polyethylene terephthalate (PET) film using an applicator to give a coating film of 1 (one) mm thickness. Then the coating film was dried to give a dried coating film. The glossiness of the dried coating film was determined with a gloss meter (VGS type, Nippon Denshoku Ind., Co., Ltd.) at an angle of 20°.

(5) Particle Diameter

The volume average particle diameter of colored polymer particles, Dv, and the particle diameter distribution of colored polymer particles referred as Dv/Dp, that is the ratio of the volume average particle diameter, Dv, and number average particle diameter, Dp, was determined with Multisizer® (Beckman Coulter, Inc.). Determination with Multisizer® was carried out by the following conditions. Aperture diameter=100 μm, medium=Isoton II, concentration=10% and determined number of particles=100,000.

(6) Image Density

A developer (toner) was placed in a commercial non-magnetic one component developing printer (Microline 3010C, Oki Data Corp.) and solid printed in a square of 50 mm×50 mm a sheet of print paper under conditions at 23° C. and 50% humidity on. During the printing, developing bias potential was varied to change developed toner amount, M/A. The developed toner amount, M/A, was calculated by sampling of unfixed image from the printer and the developed toner on the copy paper was blown off with air and by the following equation.

$$M/A(\mathrm{mg/cm^2})=(W1-W2)/25\ \mathrm{cm^2}$$

W1=Weight of the sheet of copy paper before blowing off the toner (mg)

W2=Weight of the sheet of copy paper after blowing off the toner (mg)

The image density of solid fixed image on a square of 50 mm×50 mm was determined with a color reflection type densitometer (404A, X-Light) when M/A of the solid fixed image was 0.45 mg/cm$^2$.

Example 1

In the dispersing step, the colorant was finely dispersed in the polymerizable monomer using a dispersion system shown in FIG. 1. The dispersion system shown in FIG. 1 is built up of a media type dispersing machine 1 and a holding tank 5, which are connected together by way of a downward path comprising lines 12 and 14 and an upward path comprising a line 15.

The media type dispersing machine 1, which was built of a rotor 16 and a media particle separation screen 18 which are located on a driving shaft 19 and operable to rotate simultaneously in association with rotation of the driving shaft 19 in a casing 2 having a liquid inlet 3 and a liquid outlet 4, and in the internal space of which a number of media particles 17 are contained, as shown by a cross sectional FIG. 2, was used.

At one end of the rotor 16, there is provided a cylindrical portion 24 having a plurality of media particle discharge slits 23. Inside this cylindrical portion 24 the media particle separation screen 18 is located. Introduced into the casing 2 through the liquid inlet 3, a liquid passes through the media particle separation screen 18, leaving the liquid outlet 4.

As the driving shaft 19 is rotated by a motormounted on the media type dispersing machine, the rotor 16 mounted on the driving shaft 19 and the media particle separation screen 18 are rotated at the same time. As a mixed liquid containing a polymerizable monomer and a colorant is continuously fed into the casing 2 through the liquid inlet 3, centrifugal force generated by the rotation of the rotor 16 is combined with the action of media particles 17 to finely disperse the colorant throughout the polymerizable monomer.

The polymerizable monomer dispersion with the colorant finely dispersed therein passes through the media particle separation screen 18, and is discharged out of the liquid outlet 4 via the liquid discharge path 25. If this polymerizable monomer dispersion is fed back into the holding tank 5 for recirculation in the same media type dispersing machine, it is then possible to obtain a dispersion with the colorant more finely dispersed therein.

In the holding tank 5, 89 parts of styrene, 11 parts of n-butyl acrylate, five parts of a magenta colorant (a mixture of C.I. Pigment Red 150 and C.I. Pigment Red 31), and one part of a pigment dispersant (a basic high-molecule, AJISPER® PB-821, Ajinomoto Fine-Techno Co., Inc.) were poured and stirred with agitating blades 7 with a agitating motor 6 to give a mixed solution comprising the polymerizable monomer and the magenta colorant. During the process, a temperature controlling medium (warm or cold water) was introduced through a temperature controlling medium inlet 9 of jacket 8 and discharged from a temperature controlling medium outlet 10 to adjust the temperature of mixed solution at 25° C.

The mixed solution comprising the magenta colorant was continuously supplied in the media type dispersing machine 1, the operating conditions of which was controlled as follows, in via valve 11, and lines 12 and 14 from the bottom of the holding tank 5 using a circulation pump 13 and through the liquid supplying inlet 3 at a supply rate of 2 kg/minute:

Space volume of casing: 0.63 L,

Media particles: Zirconia beads of 0.1 mm diameter,

Filled amount of media particles: 0.54 L (85% to the space volume of casing), and Rotation rate of driving shaft: 2546 rpm (peripheral speed of rotor tip 12 m/sec).

Continuous supply of the mixed solution comprising magenta colorant from the liquid supplying inlet 3 receives centrifugal force generated by the rotation of the rotor 16 and sharing force due to vigorous movement of media particles 17 and finely pulverizes magenta colorant. The polymerizable monomer dispersion, in which the magenta colorant is finely pulverized, is separated by the media particle separation screen 18 from media particles and discharged outside through a flow path 25 and then the liquid discharging outlet 4. The polymerizable monomer dispersion discharged from the liquid discharging outlet 4 is returned into the holding tank 5 through line 15.

The polymerizable monomer dispersion recycled in the holding tank 5 is continuously fed again into the media type dispersing machine via lines 12 and 14. As shown above, the polymerizable monomer dispersion is treated for dispersion by circulation in the media dispersing machine.

During dispersion treatment, media particles 17 which is transferred to around the surface of the media particle separation screen 18 is returned to the dispersion chamber by the centrifugal forth effects generated by rotating rotor 16 and the media particle separation screen 18 through the media particle discharging slits 23 of the cylindrical portion 24 equipped on one end of the rotor 16 without retention on the surface of the media particle separation screen 18.

Therefore, the inner pressure of the casing 2 was stabilized at 0.05 Mpa during dispersion treatment. During the operation, temperature control was conducted by supplying cooled water into a jacket 22 from a cooling medium inlet 20 and discharging the cooling water from the cooling medium outlet 21 so that the temperature of the polymerizable monomer dispersion, in which the magenta colorant is dispersed and which is to be discharged from the liquid discharging outlet 4, was kept at 25° C.

Dispersion treatment was carried out to make circulation times (θ) 10 in 60 minutes and the operation was discontinued. The circulation times (θ) is calculated by the following equation.

$$\text{Number of circulation } (\theta) = \text{Treated period (min.)} / \text{period required for one circulation (min./times)}$$

The required period (t) for one circulation is obtained by the following equation.

$$t = W/V$$

t: Required period for one circulation (min./times)

W: Amount of input in holding tank (kg)

V: Amount of supplied liquid with circulation pump (kg/min.)

Then, 1.0 part of a charge control agent (styrene/acrylic resin, FCA-626N, Fujikura Kasei Co., Ltd.), 0.25 part of a polymethacrylic acid ester macromonomer (AA6, Toagosei Co., Ltd.) and 10 parts of dipentaerythritol hexamyristate were added in 100 parts of the polymerizable monomer dispersion with finely dispersed magenta colorant, stirred and dissolved to give a polymerizable monomer composition.

While an aqueous solution composed of 50 parts of ion exchanged water with dissolved 5.0 parts of sodium hydroxide (an alkali metal hydroxide) was gradually added in an aqueous solution composed of 250 parts of ion exchanged water with dissolved 6.5 parts of magnesium chloride (a water-soluble polyvalent metal salt) under stirring and an aqueous dispersion of magnesium hydroxide colloid (a hardly water-soluble metal hydroxide colloid) was prepared.

In the resultant aqueous dispersion of magnesium hydroxide colloid, the polymerizable monomer composition shown above was poured and stirred. Then 1.75 parts of tert-dodecyl mercaptan as a molecular weight modifier, 0.25 part of divinylbenzene as a crosslinkable monomer and 5.0 parts of tert-butyl peroxy-2-ethyl hexanoate (PERBUTYL® O, NOF Corp.) as a polymerization initiator were further added and highly shared and stirred at 15,000 rpm for 10 minutes with an inline type emulsifier (MILDER®, Ebara Corp.) to give droplets of polymerizable monomer composition.

The aqueous dispersion with dispersed droplets of polymerizable monomer composition was poured in a reaction vessel equipped with agitating blades and caused to start polymerization reaction at 90° C. The polymerization reaction was continued up to give almost 100% polymerization and conversion rate. Then, 1.0 part of methyl methacrylate of polymerizable monomer for shell and 0.1 part of 2,2'-azobis[2-methyl-N-[1,1-bis(hydroxymethyl)-2-hydroxyethyl]propionamide] (VA086, Wako Pure Chemical Ind., Ltd.) dissolved in 10 parts of ion exchanged water were added while maintaining the reaction temperature at the same temperature. The reaction was continued for further three hours at 90° C. and the reaction was discontinued to obtain an aqueous dispersion of the colored polymer particles having core-shell structure. The aqueous dispersion showed pH 9.5.

The resultant aqueous dispersion comprising the colored polymer particles was adjusted to pH 6 or less with sulfuric acid under stirring, washed with an acid (at 25° C. for 10 minutes), filtered to separate water, mixed with 500 parts of new ion exchanged water to give a slurry again and washed with water. Then, filtration, dehydration and washing with water of the slurry were repeated several times and filtered to give wet solid component of the colored polymer particles. The wet colored polymer particles were placed in a vacuum dryer and dried under reduced pressure of 30 torr and at 50° C.

The particle diameter distribution of the dried colored polymer particles showed volume average particle diameter, Dv=7.33 μm, number average particle diameter, Dp=6.15 μm, volume % of particles having a diameter of 16 μm or over=1.7%, volume % of particles having a diameter of 20 μm or over=1.1% and number % of particles having a diameter of 5 μm or less=23.5%.

In 100 parts of the obtained colored polymer particles having core-shell structure, 0.5 part of colloidal silica subjected to hydrophobicity-imparting treatment (Nippon Aerosil Co., Ltd.) and 2.0 parts of colloidal silica subjected to hydrophobicity-imparting treatment (RX-300, Nippon Aerosil Co., Ltd.) were added and mixed with Henschel mixer to give non-magnetic one component developer (magenta toner). The results are shown in Table 1.

Example 2

Colored polymer particles (polymerized toner) and magenta toner were prepared by similar manners with those in Example 1 except for the use of zirconia beads of 0.3 mm diameter as media particles instead of those of 0.1 mm diameter. The results are shown in Table 1.

Comparative Example 1

Figure 4:
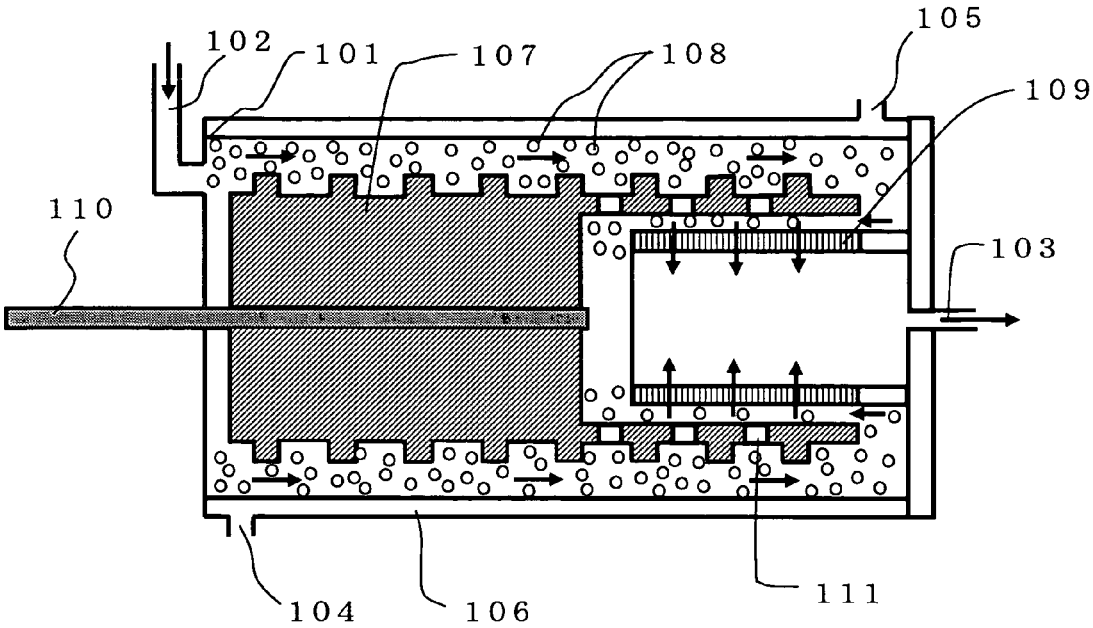
FIG. 4 shows a cross sectional drawing of a conventional media type dispersing machine (Comparative example 1).

Polymerizable monomer dispersion and colored polymer particles (polymerized toner) and magenta toner were prepared by similar manners with those in Example 1 except for using zirconia beads of 0.1 mm diameter in 85% of the space volume of casing and, operating the rotor at peripheral speed 12 m/sec using a media dispersing machine (Agitator mill LMZ, Ashizawa Finetech Ltd.) shown in FIG. 4 instead of media dispersing machine used in Example 1.

During dispersion treatment, inner pressure of the casing gradually elevated up to 0.2 Mpa. The withstand pressure specification of Agitator mill LMZ is 0.3 Mpa and the operation is discontinued to wait the decline of pressure and intermittent operation was performed. The cause of elevated pressure was poor separation of the polymerizable monomer dispersion with dispersed colorant and media particles due to localization of media particles on the media particle separation screen. The results are shown in Table 1.

Comparative Example 2

Figure 5:
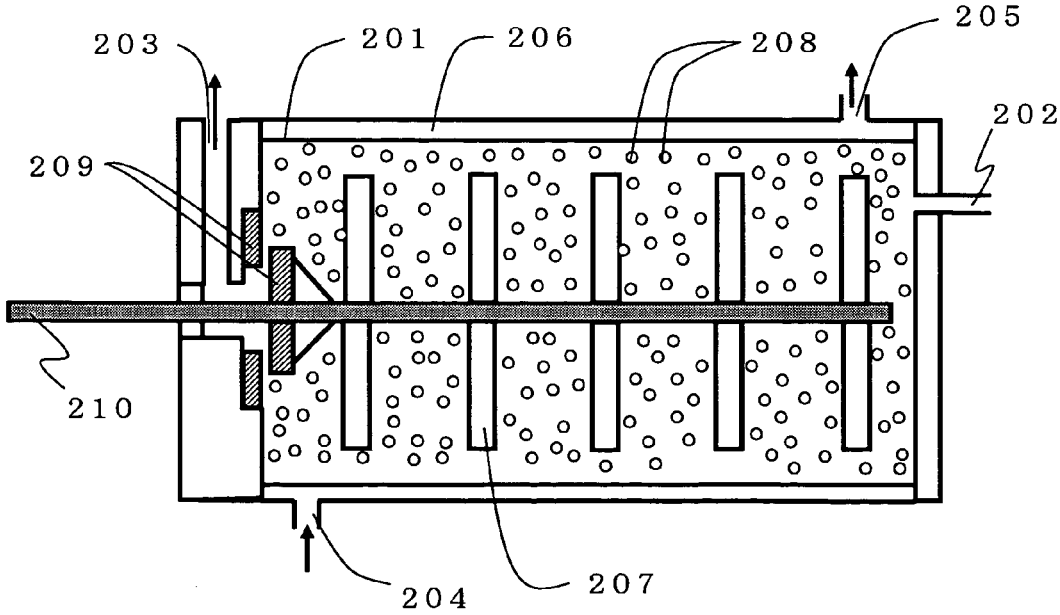
FIG. 5 shows a cross sectional drawing of the other conventional media type dispersing machine (Comparative example 2)

Polymerizable monomer dispersion and colored polymer particles (polymerized toner) and magenta toner were prepared by similar manners with those in Example 1 except for filling zirconia beads of 0.3 mm diameter in 85% of the space volume of casing and operating the rotor at peripheral speed 12 m/sec using a media dispersing machine (DYNO-MILL TYPE KDL-PILOT, Shinmaru Enterprizes Corp.) shown in FIG. 5 instead of the media dispersing machine used in Example 1.

During dispersion treatment, inner pressure of the casing gradually elevated up to 0.3 Mpa. The cause of elevated pressure was poor separation of the polymerizable monomer dispersion with dispersed colorant and media particles due to localization of media particles on the gap separator of media separating part. The results are shown in Table 1.

Comparative Example 3

Polymerizable monomer dispersion and colored polymer particles (polymerized toner) and magenta toner were prepared by similar manners with those in Example 1 except for using high pressure ballistic type dispersing machine, ULTIMAIZER® (Ultimaizer system HJP25030, Sugino Machine Ltd.) instead of the media dispersing machine used in Example 1 and dispersing under 60 MPa with 10 times pass (that is 10 times circulation in the dispersing machine). The results are shown in Table 1.

TABLE 1

| | Example | | Comparative example | | |
|---|---|---|---|---|---|
| | 1 | 2 | 1 | 2 | 3 |
| Separability of media | A | A | B | B | — |
| Dispersibility of colorant (Number of colorant particles over major axis 0.5 μm) | 0 | 0 | 8 | 63 | 100< |
| Viscosity of polymerizable monomer dispersion after dispersion treatment of the colorant (mPa · s) | 840 | 780 | 800 | 650 | 470 |
| Glossiness of dried coated film formed from dispersion (%) | 79 | 72 | 68 | 61 | 57 |
| Polymerized toner | | | | | |
| Volume average particle diameter (μm) | 7.33 | 7.46 | 7.65 | 7.76 | 7.69 |

TABLE 1-continued

| | Example | | Comparative example | | |
|---|---|---|---|---|---|
| | 1 | 2 | 1 | 2 | 3 |
| Particle diameter distribution (Dv/Dp) | 1.19 | 1.20 | 1.26 | 1.28 | 1.27 |
| Image density | 1.45 | 1.44 | 1.33 | 1.27 | 1.28 |

INDUSTIRAL APPLICABILITY

According to the present invention, a polymerized toner with excellent characteristic features of toner with marked dispersibility of the colorant, homogenous and sharp particle diameter distribution, favorite image density and color tone can be effectively produced. The production process of the present invention is particularly suitable for production of color toners. The polymerized toner produced by the present invention can be used as a main component of developer for development of electrostatic images in electrophotographic image forming apparatus.

What is claimed is:

1. A process for producing a polymerized toner, comprising a step 1 of preparing a polymerizable monomer composition comprising at least a polymerizable monomer and a colorant, and a step 2 of polymerizing the polymerizable monomer composition in an aqueous medium to form colored polymer particles, wherein:

said step 1 comprises a dispersing step of dispersing said colorant finely in a mixed solution comprising at least a polymerizable monomer and a colorant with a dispersing machine, wherein:

(1) said dispersing machine is a media type dispersing machine which comprises a cylindrical casing having a liquid inlet and a liquid outlet, in which there are provided a driving shaft, and a rotor and a media particle separation screen mounted on said driving shaft and operable to rotate simultaneously in association with rotation of said driving shaft, wherein said rotor is provided at one end with a cylindrical portion having a plurality of media particle discharge slits, said media particle separation screen is located inside the cylindrical portion of said rotor, a liquid introduced from the liquid inlet into the casing passes through the media particle separation screen and leaves the casing through the liquid outlet via a discharge path interposed between the driving shaft and said rotor, and media particles are contained in an internal space between the inner surface of the casing and the outer surface of the rotor, and (2) said dispersing step comprises a step of continuously feeding a mixed liquid comprising at least the polymerizable monomer and the colorant from the liquid inlet into the casing, while the rotor and media particle separation screen are simultaneously rotated in association with the rotation of said driving shaft, so that the colorant is finely dispersed in said mixed liquid by virtue of centrifugal force generated by rotation of the rotor and media particles, and passing a polymerizable monomer dispersion with the colorant finely dispersed therein through the media particle separation screen to deliver the dispersion out of said dispersing machine through the liquid outlet such that the media particles receive the centrifugal force of the rotating media particle separation screen and return to the internal space between the inner surface of the casing and the outer surface of the rotor while the polymerizable monomer dispersion is discharged.

2. The process according to claim 1, wherein in the dispersing step, the temperature of the liquid in the media type dispersing machine is controlled to within the range of 10 to 30° C.

3. The process according to claim 1, wherein in the dispersing step, the polymerizable monomer dispersion delivered out of the dispersing machine through the liquid outlet is again continuously fed into the same media type dispersing machine through the liquid inlet, wherein said polymerizable monomer dispersion is circulated at least twice.

4. The process according to claim 1, wherein in the dispersing step, a mixed liquid comprising at least the polymerizable monomer and the colorant is continuously fed from a holding tank with said mixed liquid stored therein into the casing of the media type dispersing machine through the liquid inlet thereof, so that the colorant is finely dispersed in said mixed liquid by virtue of centrifugal force generated by rotation of the rotor and media particles, and a polymerizable monomer dispersion with the colorant finely dispersed therein is delivered into the holding tank through the liquid outlet in the media type dispersing machine.

5. The process according to claim 4, wherein the polymerizable monomer dispersion delivered into the holding tank is again continuously fed into the same media type dispersing machine, wherein said polymerizable monomer dispersion is circulated at least twice.

6. The process according to claim 4, wherein in the dispersing step, the temperature of the liquid in the holding tank and the temperature of the liquid in the media type dispersing machine are controlled to within the range of 10 to 30° C.

7. The process according to claim 1, wherein in the dispersing step, the degree of dispersion of the colorant by the media type dispersing machine is controlled such that when a coating film formed using a polymerizable monomer dispersion in which the colorant is dispersed at a concentration of 3% by weight is observed at a magnification of 400× under an optical microscope, the number of colorant particles having a major axis over 0.5 μm, included in a field of view of 100 μm×100 μm of said coating film, is 5 or less.

8. The process according to claim 1, wherein in the dispersing step, the degree of dispersion of the colorant by the media type dispersing machine is controlled such that when a coating film formed using a polymerizable monomer dispersion in which the colorant is finely dispersed at a concentration of 4.5% by weight is measured at an angle of 200 by means of a glossmeter, the glossiness of said coating film is greater than 60%.

9. The process according to claim 1, wherein in the dispersing step, the mixed liquid to be fed into the casing from the liquid inlet further comprises a basic high-molecular compound as a pigment dispersant.

10. The process according to claim 1, wherein the rotor is formed of zirconia, ultra-high-molecular-weight polyethylene or nylon.

11. The process according to claim 1, wherein in the dispersing step, the rotor is rotated at 2 in/sec or more in terms of the peripheral speed of an edge thereof.

12. The process according to claim 1, wherein the media particles are spherical particles having a particle diameter of the range of 0.05 to 0.5 mm.

13. The process according to claim 1, wherein the media particles to be comprised in the media type dispersing machine have an apparent packing fraction of 60 to 95% by volume.

14. The process according to claim 1, wherein the polymerizable monomer dispersion with the colorant finely dispersed therein, obtained at the dispersing step, is used at the step 2 as the polymerizable monomer composition after an additive component or components other than the colorant are dispersed or dissolved therein as needed.

15. The process according to claim 1, wherein in the step 2, the polymerizable monomer composition comprising at least the colorant and the polymerizable monomer is suspension polymerized in an aqueous medium comprising a dispersion stabilizer to form colored polymer particles.

16. The process according to claim 1, wherein in the step 2, the polymerizable monomer composition comprising at least the colorant and the polymerizable monomer is suspension polymerized in an aqueous medium comprising a dispersion stabilizer to form colored polymer particles, and a polymerizable monomer for shell is further polymerized in the presence of said colored polymer particles to form a core-shell structure colored polymer particles.

17. The process according to claim 1, wherein in the step 2, a colored polymer particles having a volume average particle diameter of 3 to 10 μm and a particle diameter distribution of 1.3 or less is formed.

* * * * *